United States Patent [19]

Castlebury

[11] Patent Number: 4,898,198

[45] Date of Patent: Feb. 6, 1990

[54] CANOPY APPARATUS FOR CHILDREN'S SWINGS

[76] Inventor: Gerald E. Castlebury, Rte. 2, Box 144C, Ruther Glen, Va. 22546

[21] Appl. No.: 304,638

[22] Filed: Feb. 1, 1989

[51] Int. Cl.[4] ..... A63G 9/00; E04H 15/58

[52] U.S. Cl. ..... 135/90; 272/85; 135/96; 135/117

[58] Field of Search ..... 135/90, 117, 115, 96; 272/85, 1 R

[56] References Cited

U.S. PATENT DOCUMENTS

| | | | |
|---|---|---|---|
| 882,875 | 3/1908 | Diehl . | |
| 952,879 | 3/1910 | Crocker . | |
| 1,054,251 | 2/1913 | Stone . | |
| 2,291,721 | 8/1942 | Hutaff, Jr. | 272/85 |
| 3,397,881 | 8/1968 | Hedgecock . | |
| 4,351,524 | 9/1982 | Gomes | 272/85 |

FOREIGN PATENT DOCUMENTS

| | | | |
|---|---|---|---|
| 1125606 | 3/1962 | Fed. Rep. of Germany | 272/85 |
| 1378609 | 10/1964 | France | 272/85 |
| 169174 | 10/1959 | Sweden | 272/85 |

OTHER PUBLICATIONS

Renner-Smith, Susan, "What's New In Home Improvement": Popular Science, 3/1983, 1 page.

*Primary Examiner*—Carl D. Friedman
*Assistant Examiner*—Caroline D. Dennison
*Attorney, Agent, or Firm*—Henderson & Sturm

[57] ABSTRACT

A canopy apparatus (10) for conventional A-frame swing constructions (100) wherein the canopy apparatus (10) comprises a pair of support units (11) operatively connected to the horizontal support bar (103) of the swing set (100) and a cover unit (12) operatively attached to and suspended from the pair of support units (11).

2 Claims, 1 Drawing Sheet

FIG. 1.
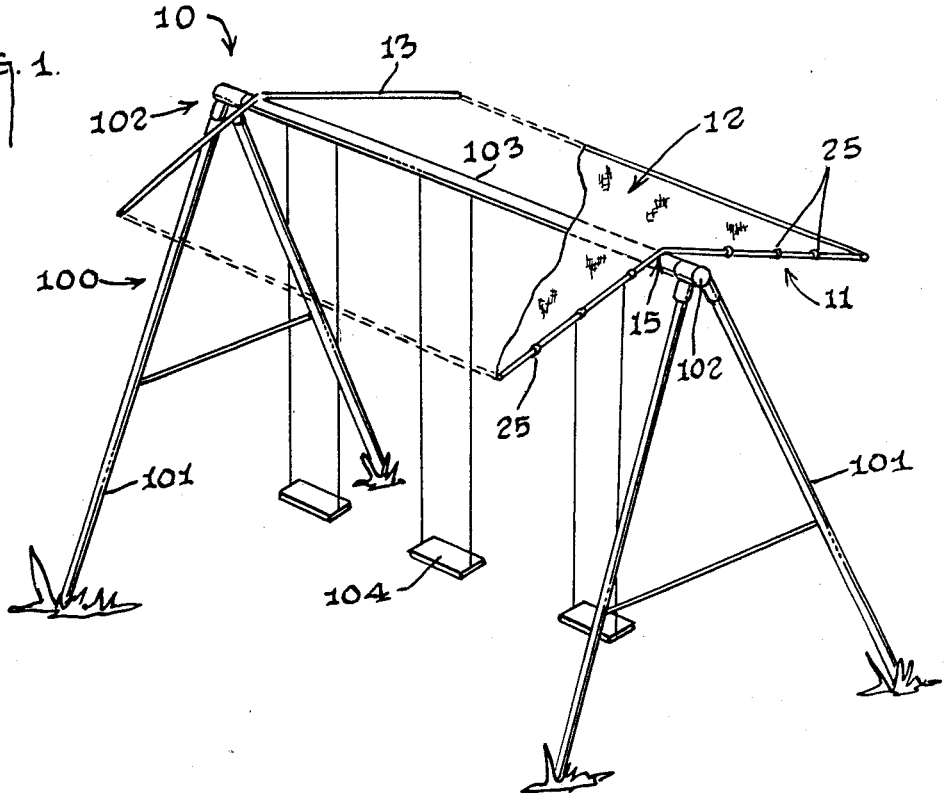
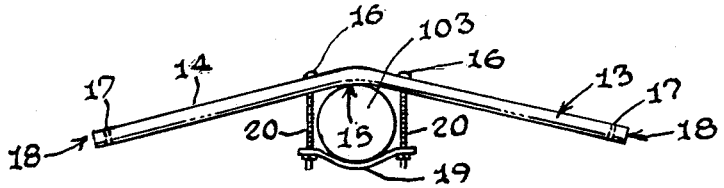
FIG. 2.
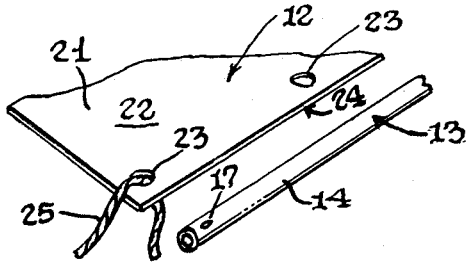
FIG. 3.

CANOPY APPARATUS FOR CHILDREN'S SWINGS

TECHNICAL FIELD

The present invention relates generally to canopy constructions and more particularly to a canopy apparatus that is intended to be installed over a conventional A-frame swing set.

BACKGROUND OF THE INVENTION

As can be seen by reference to the following U.S. Pat. Nos. 1,054,251; 882,875; 3,397,881; and, 952,879 the prior art is replete with myriad and diverse canopy arrangements for use as a covering for swing structures.

While all of the aforementioned prior art constructions are more than adequate for the particular purpose and function for which they have been specifically designed; they are also uniformly restrictive in their deployment being relegated to use solely in conjunction with their respective swing constructions.

Given the fact that the most common of all swing set configurations that are employed on both public and private playgrounds involves an A-frame construction having two A-frame vertical supports attached at their apex by an elongated horizontal bar from which are suspended a plurality of swings it comes as a surprise that to date no one has developed a canopy apparatus that can be employed in conjunction with this extremely popular structural configuration.

As a consequence of the foregoing situation, the present invention was specifically developed to address this long overlooked vacuum in the canopy art.

BRIEF SUMMARY OF THE INVENTION

Briefly stated, the canopy apparatus that forms the basis of present invention comprises a pair of support units and a cover unit that are operatively engaged with the horizontal support bar of a conventional A-frame swing set.

Each of the support units comprises a generally V shaped support arm whose vertex rests on top of the horizontal support bar wherein each support arm is provided with a pair of apertures which extend through an arc disposed on opposite sides of the middle of the respective support arms.

In addition the support units further comprise a clamp member associated with each of the support arms; wherein, each clamp member is further provided with a pair of securing elements which are adapted to project through the apertures in the support arm to frictionally engage a portion of the horizontal support bar intermediate the respective support arms and their related clamp members.

The cover unit comprises a generally rectangular sheet of material having a plurality of grommets disposed along at least two opposed sides; and, a pair of tether elements that are adapted to pass through the grommets on the opposed sides of the sheet material with the support arms; wherein, the sheet of material will form a shade awning over the swings that are suspended from the horizontal support bar.

BRIEF DESCRIPTION OF THE DRAWINGS

These and other objects, advantages, and novel features of the canopy apparatus will become apparent from the detailed description of the best mode for carrying out the preferred embodiment of the invention which follows; particularly when considered in conjunction with the accompanying drawings, wherein:

FIG. 1 is perspective view of the canopy apparatus installed on a conventional A-frame swing set construction;

FIG. 2 is an enlarged end view of the canopy apparatus; and,

FIG. 3 is an enlarged detail view of the operative engagement between the cover unit and support units.

BEST MODE FOR CARRYING OUT THE INVENTION

As can be seen by reference to the drawings and in particular to FIG. 1, the canopy apparatus that forms the basis of the present invention is designated generally by the reference numeral (10). The canopy apparatus (10) comprises in general a pair of support units (11) and a cover unit (12) that are adapted to be operatively engaged with a conventional A-frame swing construction (100). These units will now be described in seriatim fashion.

Prior to embarking on a detailed description of the canopy apparatus (10) of this invention it would be advisable to describe in general the conventional A-frame swing construction (100) that the apparatus (10) was specifically developed to be deployed in conjunction with.

For the purposes of this application, the conventional A-frame support members (101) operatively connected on their upper ends (102) to a horizontally disposed support bar (103) which forms an elevated support surface for at least one swing member (104).

As can best be seen by reference to FIGS. 1 and 2, each of the pair of support units (1) comprises an elongated support arm member (13) having an inverted generally shallow V-shaped configuration; wherein, the support arm member (13) is preferably fabricated from a hollow tubular element (14).

As can also be seen particularly by reference to FIG. 2, the vertex (15) of the support arm member (13) is designed to rest upon the top of the horizontal support bar (103). In addition the support arm member (13) is further provided with a pair of inboard apertures (16) that are disposed on opposite sides of the vertex (15) of the support arm member (13); and, an optional pair of outboard apertures (17) that are disposed proximate the ends (18) of each support arm member (13).

Still referring to FIG. 2, it can be seen that each of the support units further comprises a clamp member (19) having a plurality of elongated securing elements (20) that are dimensioned to be received in and project through the inboard apertures (16) on each support arm member (13); wherein, a portion of the horizontal support bar (103) will be captively engaged between each of the support arm members (13) and their associated clamp members (19) and elongated securing elements (20).

Turning now to FIGS. 1 and 3, it can be appreciated that the cover unit (12) comprises an elongated generally rectangular cover member (21) fabricated from opaque material (22); wherein, at least two of the opposed sides of the cover member (21) are provided with a plurality of spaced grommets (23) proximate to their respective edges (24).

In addition the cover unit (12) further includes a plurality of tether elements (25) which are dimensioned to extend through the grommets (23) to operatively secure the cover unit (12) to the support units (11) in a well recognized fashion. Furthermore this invention also contemplates the use of tether elements (25) that are also dimensioned to pass through the optional outboard apertures (17) at the ends (18) of the support arm members (13) to prevent the corners of the cover member (21) from becoming disengaged with the ends (18) of the support arm members (13).

Having thereby described the subject matter of this invention it should be apparent that many substitutions, modifications, and variations of the canopy apparatus (10) are possible in light of the above teachings. It is therefore to be understood that the invention as taught and described herein is only to be limited to the extent of the breadth and scope of the appended claims

I claim:

1. A canopy apparatus in combination with a swing construction including a pair of vertically disposed A-frame support members operatively connected on their upper ends to a horizontal support bar wherein the canopy apparatus consists of:

a pair of support units wherein each support unit comprises: an elongated support arm having a pair of inboard apertures disposed on opposite sides of the midpoint of the support arm; a clamp member adapted to engage the bottom of the horizontal support bar; and a pair of elongated securing elements operatively engaged with the clamp member and dimensioned to project through the pair of inboard apertures in the support arm to captively engage a portion of the horizontal support bar; wherein, each of said support arms are provided with an inverted generally shallow V-shaped configuration; and, a cover unit comprising a generally rectangular cover member fabricated from an opaque sheet of material; wherein, opposed sides of the cover member are provided with a plurality of spaced grommets and further provided with a plurality of tether elements which extend through said grommets and operatively attach said cover unit to said support units.

2. The combination of claim 1 wherein each support arm is further provided with a pair of outboard apertures formed proximate the ends of the respective support arms; wherein, tether elements are dimensioned to pass through the outboard apertures in said support arms.

* * * * *